US006065691A

United States Patent [19]

West

[11] Patent Number: 6,065,691

[45] Date of Patent: May 23, 2000

[54] FUEL INJECTION PISTON ENGINES

[76] Inventor: Geoffrey W. West, Freehills, Dodwell Lane, Bursledon, Southampton SO31 1AB, United Kingdom

[21] Appl. No.: 09/077,155

[22] PCT Filed: Nov. 19, 1996

[86] PCT No.: PCT/GB96/02850

§ 371 Date: May 21, 1998

§ 102(e) Date: May 21, 1998

[87] PCT Pub. No.: WO97/20141

PCT Pub. Date: Jun. 5, 1997

[30] Foreign Application Priority Data

Nov. 24, 1995 [GB] United Kingdom ..... 9524042

[51] Int. Cl.[7] ..... B05B 7/12

[52] U.S. Cl. ..... 239/407; 239/408; 239/410; 239/533.2; 239/533.12

[58] Field of Search ..... 239/407, 408, 239/409, 410, 533.2, 533.12

[56] References Cited

U.S. PATENT DOCUMENTS

| | | | |
|---|---|---|---|
| 4,216,753 | 8/1980 | Inoue et al. | 123/445 |
| 4,569,484 | 2/1986 | Phatak | 239/410 |
| 4,570,598 | 2/1986 | Samson et al. | 123/445 |
| 4,674,460 | 6/1987 | Asmus | 123/470 |
| 4,982,716 | 1/1991 | Takeda et al. | 123/531 |
| 5,035,358 | 7/1991 | Katsuno et al. | 239/403 |
| 5,358,181 | 10/1994 | Tani et al. | 239/409 |
| 5,772,122 | 6/1998 | Sugiura et al. | 239/408 |

FOREIGN PATENT DOCUMENTS

| | | |
|---|---|---|
| 0 678 667 | 10/1995 | European Pat. Off. . |
| 28 43 534 | 4/1979 | Germany . |
| 44 42 350 | 6/1995 | Germany . |

*Primary Examiner*—Andres Kashinikow
*Assistant Examiner*—Robin O. Evans
*Attorney, Agent, or Firm*—Michael D. Rechtin; Foley & Lardner

[57] ABSTRACT

A fuel injection, spark ignition, piston type internal combustion piston engine 1 with a fuel sprayer 2 comprising a hollow casing 3. A liquid fuel injector 4 is disposed within the upper end 5*a* of the hollow interior 5 of the casing 3, and comprises means for injecting liquid fuel into the hollow interior 5. Structure 6 is placed within the hollow interior 5 and is disposed in the path of fuel 7 injected, whereby injected fuel is temporarily deposited on the structure 6. A venturi-shaped passageway 8 enables the induction phase (stroke) of the engine 1 to remove the temporarily-deposited liquid fuel from the structure 6 and into the associated cylinder of the engine 1. The structure 6 comprises an inner body 10 of conical form disposed within an outer body 11 of annular form, so as to define an annular passageway 12 therewith. The sprayer 2 is located by a recessed 22 formed in the air inlet tract 34 of the engine 1. As the induction phase of the engine takes place, air is induced into the sprayer 2 through an auxiliary air duct 21 to remove the deposited fuel from the structure 6 and forms an air atomized spray 24 which then passes through the venturi-shaped passageway 8 where a further intermingling of air and fuel takes place.

23 Claims, 6 Drawing Sheets

FUEL INJECTION PISTON ENGINES

BACKGROUND TO THE INVENTION

This invention relates to fuel injection piston engines and is concerned with improving the performance thereof of liquid hydrocarbon fuelled, spark ignition piston type internal combustion engines.

The invention is particularly applicable to such engines wherein gasoline is the fuel. However, other liquid fuels, such as alcohol, could be used.

In most fuel injection systems employed by such engines, fuel is injected into the engine air induction tracts or air inlet valve ports downstream from the engine throttle(s).

To-day it is common practice to use fuel injectors in which a solenoid operated valve is opened in response to signals received from a computer-controlled electronic control unit (ECU). The injectors are supplied with fuel maintained at a substantially constant pressure.

The computer controlled ECU varies the frequency and duration of the injector valve opening in response to inputs which indicate such data as throttle position, engine speed, manifold depression and the temperatures of the intake air, coolant and fuel. Additional control parameters may be used including the measurement of mass air flow.

In a multi-point sequential injection system, fuel is injected into the engine so as to coincide with TDC (Top Dead Centre) or soon after TDC. The duration of the injector valve opening is determined by the ECU in accordance with the total volume of fuel required by the engine at any given time. A fundamental weakness of this system however, is that the duration of the fuel spray is not directly related to the length of the engine's air induction phase, with the result that air will continue to flow into the combustion chamber after the injector has ceased to spray. This continuation contributes to the formation of a non-homogeneous air/fuel mixture.

It is this defect that has led to disappointing results, in securing improved fuel consumption and reduced exhaust emissions, when currently available multi-point sequential systems have been adopted.

According to the present invention, a sprayer for a fuel injection, spark ignition, piston type internal combustion engine comprises a hollow casing, and means for injecting liquid fuel into the hollow interior of the casing, with structure placed within the hollow interior of the casing and disposed in the path of fuel injected, characterised in that the structure is formed whereby injected fuel is deposited on said structure, so that the induction phase of the engine causes the deposited fuel to be removed from said structure and into the engine, and in that casing outlet means are provided, comprising a venturi-shaped passageway, the inlet end of which is disposed downstream of and spaced from said structure, and operable to mix air and liquid fuel together before the mixture leaves the sprayer.

U.S. Pat. No. 4,674,460 discloses a sprayer having the features of the non-characterising portion of this statement of invention. However, this reference does not make it clear that fuel is indeed deposited on structure in the path of injected fuel and is indeed caused to be subsequently removed by the induction phase of the engine.

The term "induction phase" is used herein and is intended to include "induction stroke", as the induction stroke of the engine may not coincide entirely with the induction phase of the engine. The induction phase may, for example, begin before TDC (top dead centre) and finish after BDC (bottom dead centre).

The structure placed within the hollow interior of the casing preferably comprises an inner body disposed with an outer body of annular form, so as to define an annular passageway therewith.

Alternative structure may comprise a sheet of gauze disposed substantially normal to the path of fuel injected.

The body outlet preferably defines a venturi-shaped passageway, which may function as a sonic nozzle.

The invention also comprises a fuel injection, spark ignition piston type internal combustion engine provided with said fuel sprayer.

BRIEF DESCRIPTION OF THE DRAWINGS

Aspects of the present invention will now be described by way of example only, with reference to the accompanying drawings, wherein.

In the Figures, like reference numerals refer to like components and features.

DETAILED DESCRIPTION OF THE PREFERRED EMBODIMENT

Figure 1:
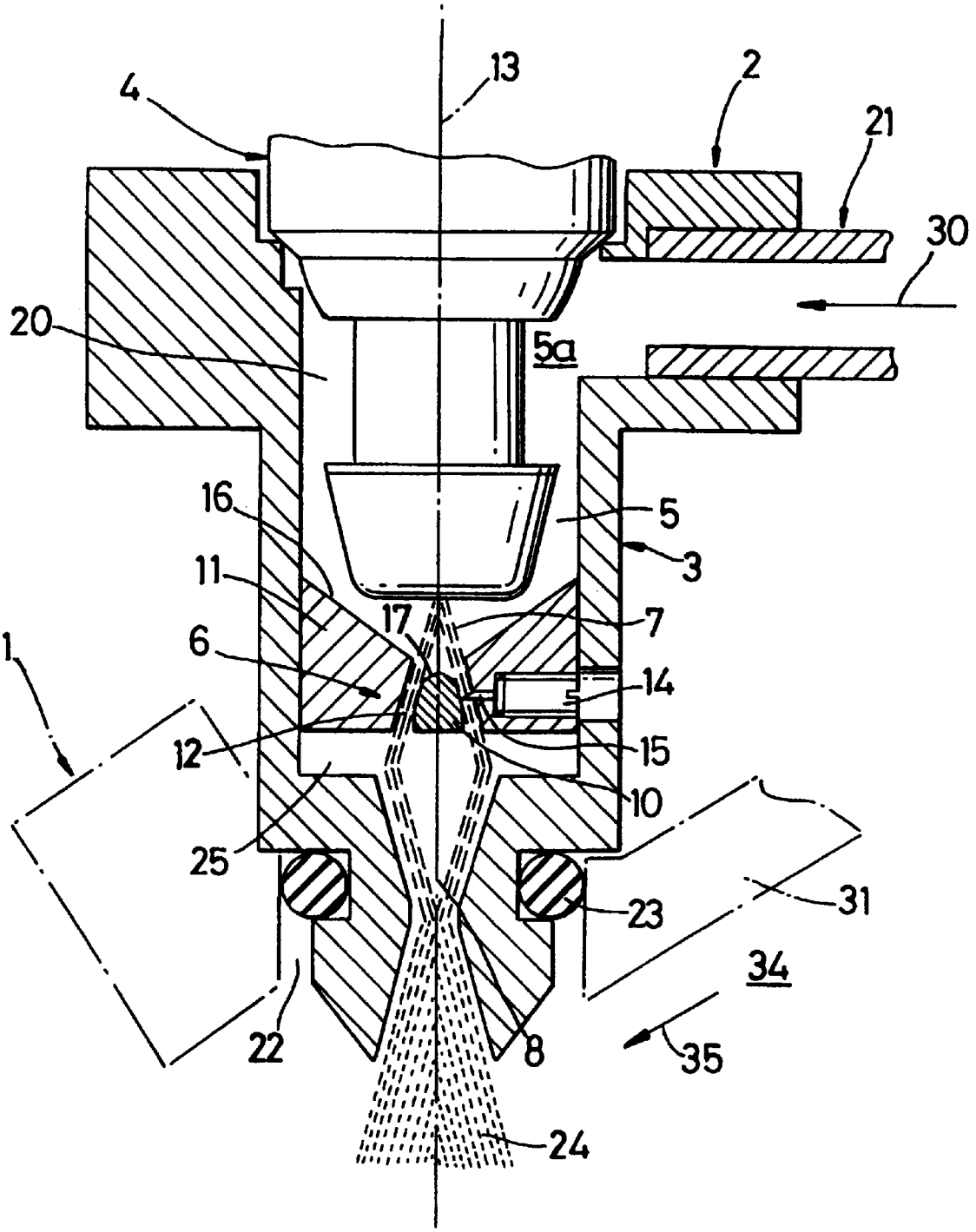
FIG. 1 is a fragmentary side view in medial section of the fuel sprayer.

With reference to FIG. 1, a fuel injection, spark ignition, piston type internal combustion piston engine 1 is provided with a fuel sprayer 2 comprising a hollow casing 3. A solenoid-operated liquid fuel injector 4 of standard form is disposed within the upper end 5*a* of the hollow interior 5 of the casing 3, and comprises means for injecting liquid fuel into the hollow interior 5. In this example, the liquid fuel is gasoline.

Suitable solenoid-operated liquid fuel injectors are available from Robert Bosch GmbH of Stuttgart, Germany, and are operable, (by electronic pulses), to supply metered quantities of liquid fuel. Other solenoid-operated liquid fuel injectors manufactured by other suppliers may, however, be used instead.

Structure 6 is placed within the hollow interior 5 and is disposed in the path of fuel 7 injected, whereby injected fuel is temporarily deposited on the structure 6. Casing outlet means comprising a venturi-shaped passageway 8 enables the induction phase of the engine 1 to remove the temporarily-deposited liquid fuel from the structure 6 and induce it into the associated cylinder of the engine 1.

The structure 6 comprises an inner body 10 of conical form disposed within an outer body 11 of annular form, so as to define an annular passageway 12 therewith.

The conical body 10 is disposed substantially co-axially within the outer body 11, and on the central longitudinal axis 13 of the hollow casing 3.

The inner body 10 of this example is supported within the outer body 11 by three equi-spaced screws 14 with pointed ends 15, although alternative mounting and centralising arrangements may be employed. Care should be taken, however, to avoid undue interference with the formation and efflux of the fuel spray.

The outer body 11 has concave upper (16) and inner (17) surfaces of conical form. Upper surface 16 is disposed at an included angle of 110°. Inner surface 17 is disposed at an angle of 30°. The sides of the inner body 10 converge at angles of substantially 30° to the axis 13, which axis is also the central axis of the inner body 15. The annular passageway 12 has a cross-sectional area of 3.1 sq mm.

All these values could change however, according to operational requirements.

A chamber 25 is formed beneath the structure 6, and is defined by a space between the under surface of the structure 6 and the bottom of the annular passageway 20 within which the fuel injector 4 is disposed. An annular disc (not shown) may be placed within the chamber 25 so as to provide additional support for the outer body 11.

The annular passageway 20 allows passage of combustion air to enter the sprayer 1 through an auxiliary air duct 21, as illustrated by arrow 30.

Figure 2:
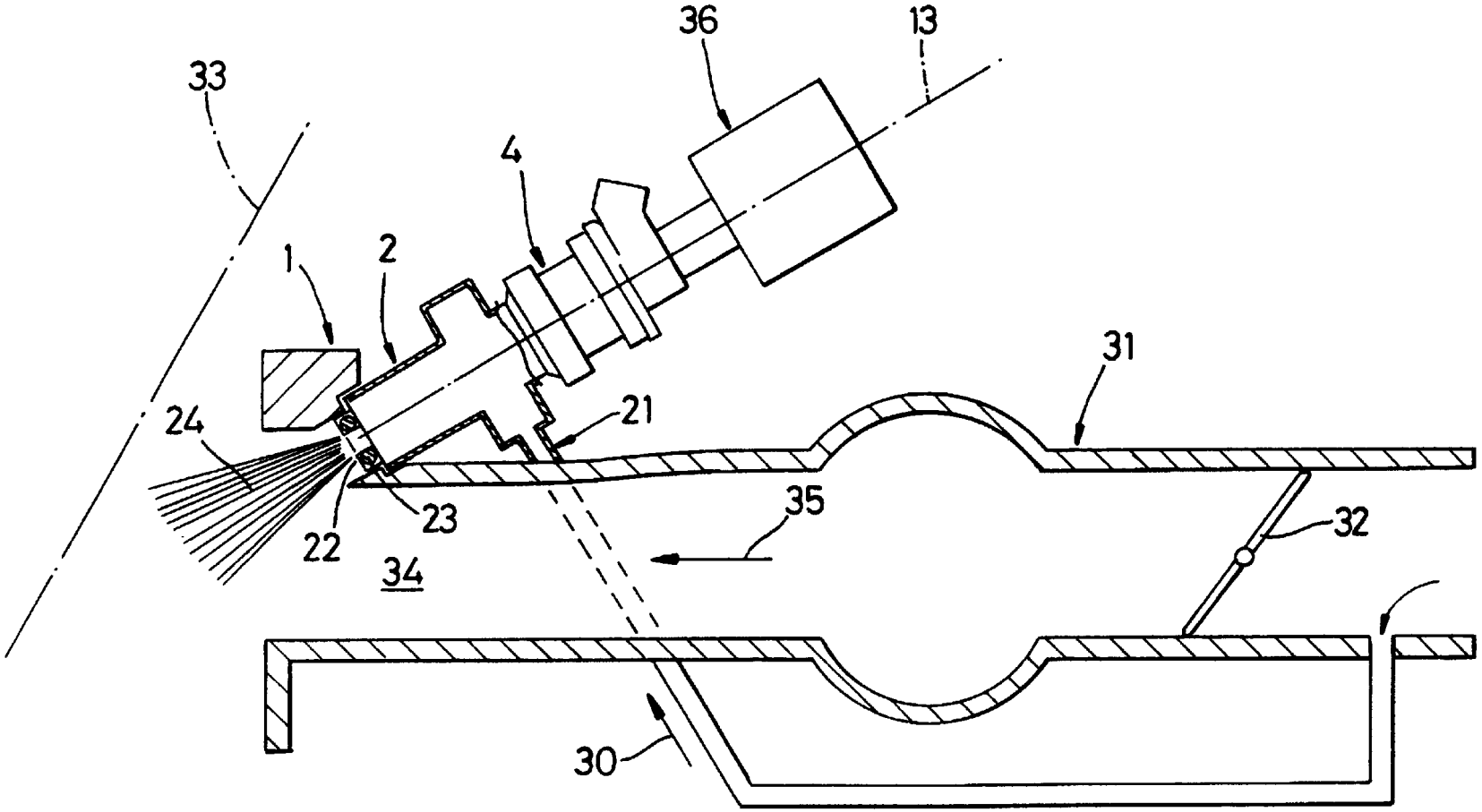
FIG. 2 is a side view, partly in section, which illustrates how the fuel sprayer 1 of FIG. 1 is mounted on an engine.

With additional reference to FIG. 2, the auxiliary air duct 21 is connected to the main air intake 31 of the engine, on the atmospheric side of throttle valve 32.

FIG. 2 also shows how in this example, the fuel sprayer 2 is mounted on the engine 1, being disposed at an angle to the horizontal. Other, alternative positions and angles could be used however, if desired, and if suitable.

The associated air inlet valve (not shown) is movable, in the conventional timed manner, along an axis 33, as it opens and closes. The engine 1 is completely conventional, except for the fuel sprayer 2, which is disposed in place of the conventional fuel injector, which may have been the injector 4.

Fuel is supplied to the injector 4 of the sprayer 2 by way of a fuel rail 36.

With reference once more to FIG. 1, the sprayer 2 is located by a recess 22 formed in the air inlet tract 34 of the engine 1. An annular seal 23 is provided to combine with the sprayer 2 in closing off the recess 22. When the injector 4 is caused to spray, in a timed manner, liquid fuel is temporarily deposited in the form of a thin film on all but the bottom surfaces of the inner and outer bodies 10, 11 of the structure 6. As the induction phase of the engine takes place, air is induced into the sprayer 2 through the auxiliary air duct 21. This induced air removes the deposited fuel from the structure 6 and forms an air atomised spray which then passes through the venturi-shaped passageway 8 where a further intermingling of air and fuel takes place, resulting in a final spray 24, which is of micro-mist form. Before the air/fuel micro-mist mixture enters the associated cylinder of the engine 1, it encounters air entering that cylinder by way of the main air intake 31, as indicated by arrow 35. (Throttle valve 32 will be open, to allow this air flow.) Further air/fuel mixing will then take place.

The preferred included angle of the initial spray 7 is substantially 30°, as is the included angle of the final spray 24. These angles may be varied, however, according to requirements.

In conventional sequential fuel injection, the fuel injector is made to spray fuel so as to coincide with TDC or soon after. The injector sprays, over most of the operating range, for only a short time in relation to the time taken to perform the piston inlet (induction) stroke. As an example, at idle speeds of the engine, the injector may spray fuel over a period of only 2 ms, whereas the induction stroke may take 150 ms. This large difference in fuel spray and induction phase time periods does not allow full mixing of fuel and combustion air.

Of course, as the engine speed and load increases, the injector valve opens more frequently and for a longer period, thus improving the ratio of injector spraying time to the air induction period. However, in the most used part of the engine operating range, small to medium throttle openings, the ratio remains unfavourable, although on a diminishing scale up to the maximum power output.

In the case of the sprayer 2 of the present invention, atomisation of the liquid fuel takes place by the use of the novel fuel/air mixing arrangement provided, as compared with the purely hydraulic spray discharged by a standard solenoid-operated fuel injector, functioning per se.

The final, venturi-shaped passageway 8 ensures thorough mixing of air and liquid fuel, before the mixture leaves the sprayer 2 as spray 24. The divergent portion of the passageway 8 allows, by a simple change of angle, a means of altering the angle of the air/fuel mixture leaving the passageway 8.

Air-assisted, solenoid-operated fuel injectors are available but provide no fuel storage function and do not employ the equivalent of the venturi-passageway 8 to produce a micro-mist air/fuel mixture.

Passageway 8 does not function as a venturi in the normal sense in that it does not use the reduction of area at the throat to induce a reduction of pressures as used in a carburettor or fluid flow measuring device. It is however venturi-shaped in that the entry angle converges into a throat portion and the angle of the exit diverges from the throat. Increasing the velocity of the air/fuel mixture assists in the final intermingling of the mixture.

At idling speeds or low fuel demands, all or most of the engine's combustion air requirements of the engine 1 are met by air supplied by way of the auxiliary air duct 21. The passageway 12 between the inner and outer bodies 10, 11, determines the maximum volume of air that flows through the auxiliary air duct 21.

The sprayer 2 may be used in conjunction with either a non-sequential solenoid injector system or a sequential solenoid injector system. In either system, the sprayer 2 of the invention enables fuel sprayed by the injector 4 to be maintained over a substantial part of the induction phase of the engine 1.

This leads to better mixing of the air/fuel charge, leading to reduced exhaust emissions and fuel consumption, together with improved torque.

The invention enables liquid fuel to be stored (on structure 6) over the non-induction strokes of the engine and then removed from the structure 6 to take the form of an air atomised fuel spray over the period of the induction phase. This feature applies however many injector sprays take place per engine revolution.

The points 15 of the screws 14 are formed so that they present only a very small obstruction to air and fuel mixture flow. When assembling a structure 6 in a sprayer 2, the screws 14 are best adjusted in conjunction with a setting jig so that the inner body 10 of the structure 6 is accurately located within the outer body 11 thereof.

Use of the sprayer 2 of the invention, with or without a catalyst converter results in a reduction in the emission of engine exhaust pollutants, such as Hydrocarbon (HC), Carbon Monoxide (CO) and Nitrous Oxides (NOx), currently measured in engine exhaust emission testing programmes.

Until recently carbon dioxide has been regarded as a harmless, odourless substance but it is now known to contribute to the Greenhouse Effect.

Use of the invention enables a well constituted homogeneous air/fuel mixture to be formed. This is in contrast to standard sequential injection systems where a short spray of liquid fuel is followed by the bulk of the combustion air charge, making full intermixing of combustion air and liquid fuel difficult to obtain.

The three way type of catalytic converter, which may be used with the engine 1, is now in almost universal use. It is termed thus because it simultaneously treats CO, HC and NOx. When it reaches its light-up temperature of circa 250° C. it begins to convert these gases. Full conversion efficiency of 90–95% is reached when the converter attains a working temperature of between 400–800° C. In congested urban use the converter may not even reach its light-up temperature. To achieve high conversion rates the converter must operate at the stoichiometric A/F/R (air fuel ratio), of 14.7:1 by weight. The primary emissions are high at this ratio; in particular the NOx emissions are almost at their peak. Fuel economy is severely affected by up to 10%. An increase in fuel consumption causes a rise in the emission of CO2. This is normally an inert harmless gas but under certain atmospheric conditions it adds to the Greenhouse Effect.

To ensure that the catalytic converter always operates at a stoichiometric A/F/R a closed loop circuit is employed. A lambda sensor is placed in the exhaust system of the engine 1, so as to send signals to the ECU which then constantly adjusts the A/F/R to within 1% of the desired level, This constitutes a 'Controlled Converter System'.

In the case of the present invention, very low levels of primary emissions are produced, thus enabling an uncontrolled catalytic converter to be used. The benefits of lean burn technology may then be employed.

Figure 3:
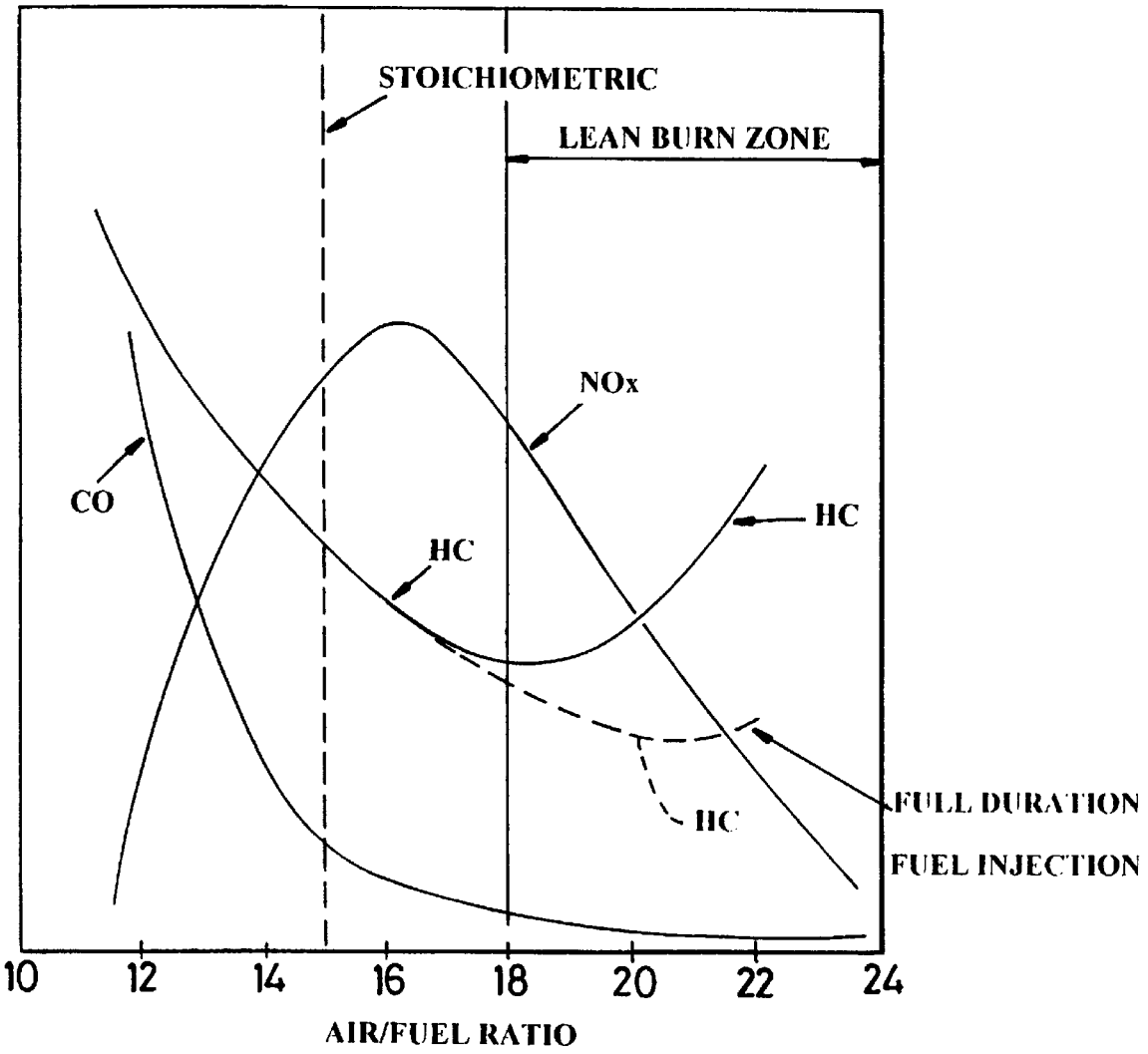
FIG. 3 is a graph which illustrates how the invention can reduce pollutants.

This will be appreciated by reference to FIG. 3, where the full line (ie non-dotted) HC curve represents the usual HC exhaust gas emission situation, that is to say, the situation when an engine is not provided with a sprayer 2 of the present invention.

The dotted portion of the HC curve represents the situation when an engine 1, provided with the inventive sprayer 2, operating with full duration fuel injection (by injector 4) over substantially the full induction stroke, whereby HC emission is reduced substantially.

The improved homogenisation of an air/fuel mixture resulting from the present invention leads not only to reduced exhaust gas emissions but also to an improved fuel economy. In addition, to increased torque production throughout the rpm range of the engine 1.

Figure 4:
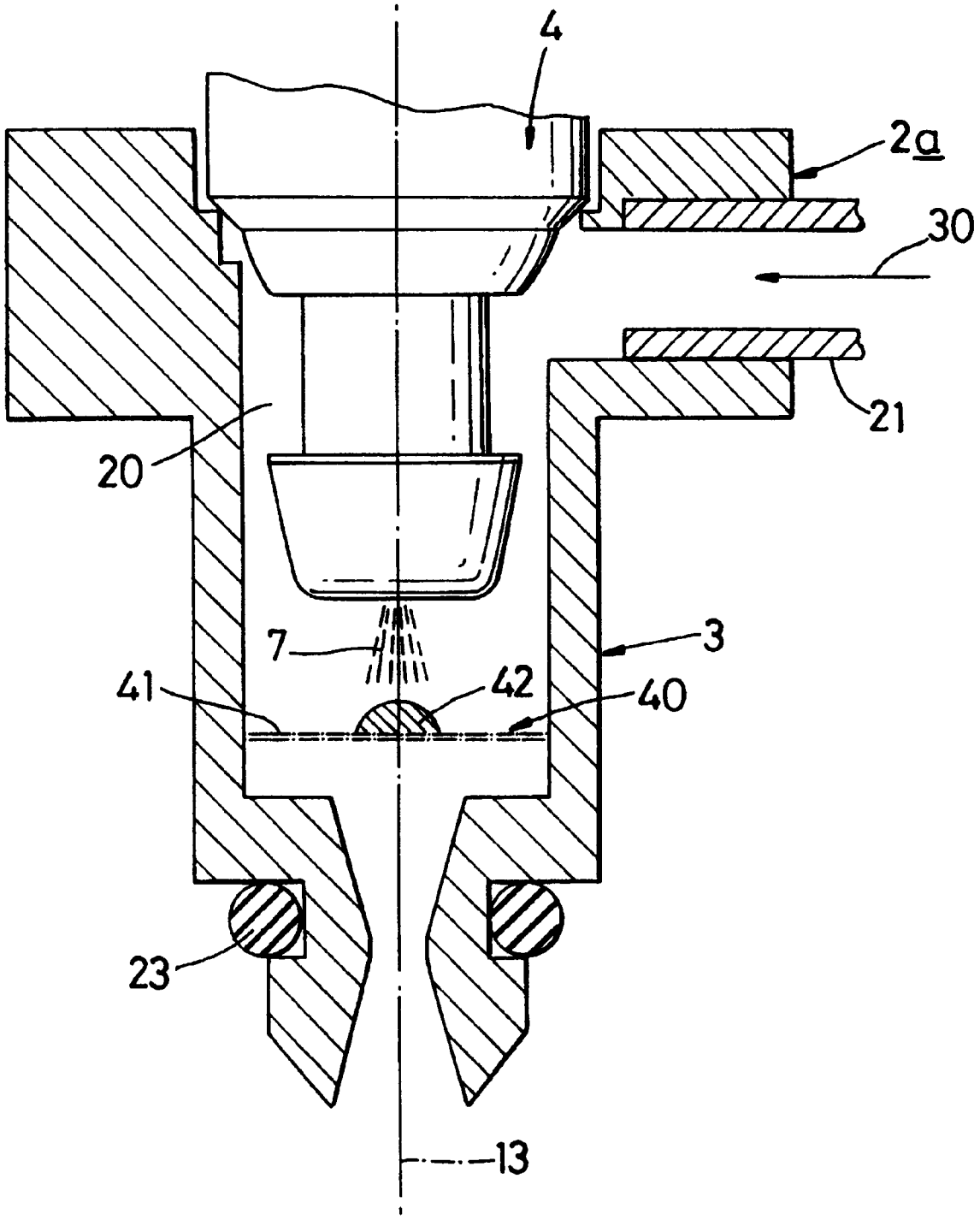
FIG. 4 is a side view which illustrates a modified sprayer.

With reference to FIG. 4, use of structure where liquid fuel is temporarily deposited need not take the form shown in FIG. 1. Instead, the structure may comprise structure 40, formed by a sheet 41 of fine gauze, preferably of expanded form, disposed substantially normal to the path of fuel 7 injected. A conical body 42 may be disposed substantially centrally on the sheet 41, so as to deflect sprayed fuel more evenly over the sheet 41.

It should be noted however that structure 40 of FIG. 4 is less efficient than structure 6 of FIG. 1.

Figure 5:
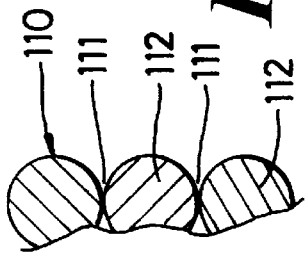
FIG. 5 is a fragmentary side view in section, which illustrates a modification using a sintered body.

With reference to FIG. 5, another alternative form of structure where liquid fuel is temporarily deposited may comprise structure at least part of which is of sintered form, and may consist of one or more sintered bodies, such as inner body 110, (which corresponds to inner body 10 of FIG. 1), whereby fuel can temporarily enter the interstices 111 thereof, formed between particles 112 of the body 110.

Such interstitial bodies may not by wholly sintered in form. They may comprise, for example, a non-sintered substrate or base, covered with a layer of sintered material.

The interstitial bodies may be metallic, ceramic or a combination of the two materials.

Under most operational conditions, the venturi-shaped passageway 8 functions as a sonic nozzle.

The air fuel mixture is then conveyed into the venturi passageway 8 by the main air charge present which is accelerated in the passageway from subsonic to supersonic velocities. When the air is slowed in the divergent portion of the passageway 8, rapid pressure rises or shock waves occur. These cause turbulence which breaks up the fuel present in the air/fuel mixture into minute particles, thus forming a hydrocarbon mist and any propensity to detonation is reduced and a progressive propagation of the flame front is encouraged.

The fuel particles are so reduced in size that when the air/fuel mixture is combined with the main combustion air charge, the usual propensity for fuel particles to deposit on the wall of the air inlet tract is avoided.

Figure 6:
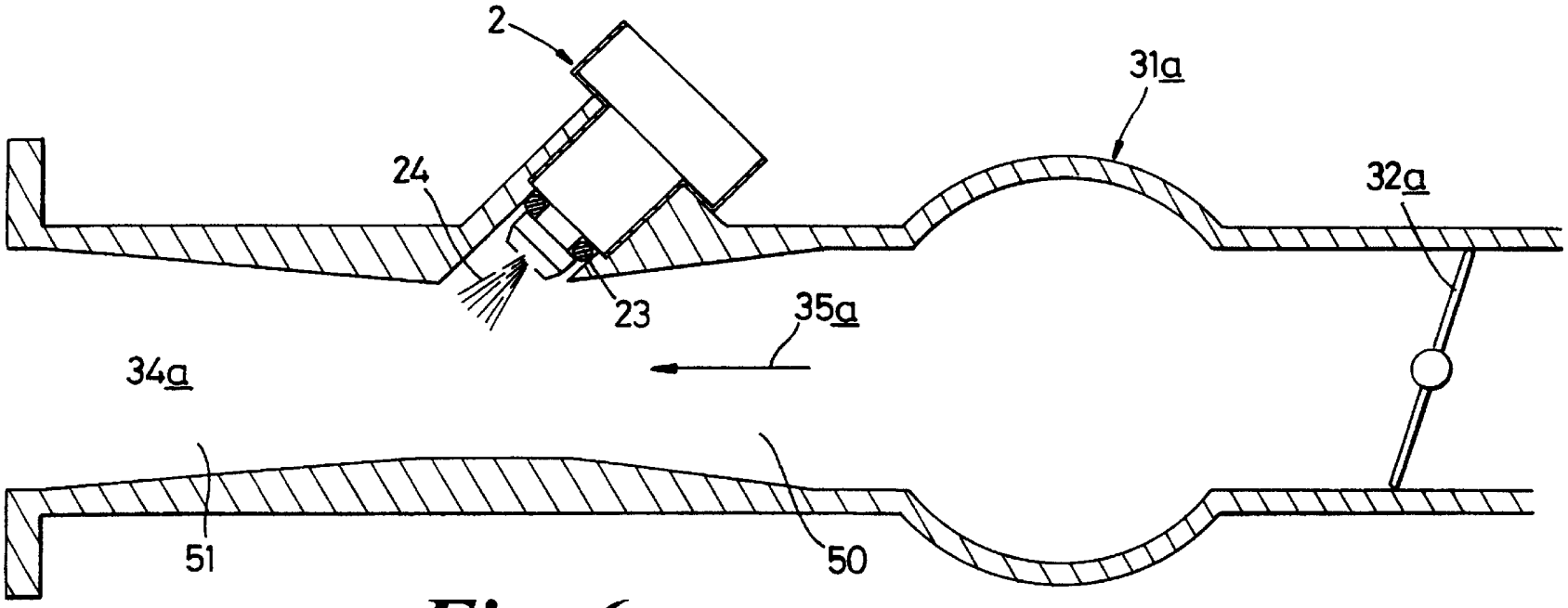
FIG. 6 shows an arrangement similar to that illustrated by FIG. 2, but is concerned with a modification thereof.

FIG. 6 illustrates a modification wherein the engine is provided with an air intake 31*a* forming an air inlet tract 34*a*.

The air inlet tract 34*a* defines a venturi having a convergent inlet 50 and a divergent outlet 51. The sprayer 2 is disposed at the junction of the convergent and divergent regions 50/51, and is thus positioned away from the associated engine inlet valve(s) and upstream thereof.

The venturi 50/51 increases the velocity of the main combustion air flow so as to assist the venturi-shaped passageway 8 to function as a sonic nozzle under operational conditions.

The modification allows the air/fuel mixture spray 24 discharged by the sprayer 2 an opportunity to blend with the main air charge in a cohesive manner.

The result is a micro-mist air/fuel mixture, which has evaporative cooling properties.

In certain engines, fuel is vaporised by spraying it on to the inlet valve(s). The present invention, particularly the modification illustrated by FIG. 6, avoids the need for such vaporisation, and has special benefits when applied to engines having more than one inlet valve per cylinder.

In tests, a standard, lean-burn fuel injection engine 1, comprising a 2.0 liter, twin over-head cam shaft, 8-valve model DOC 420i, manufactured by the Ford Motor Company gave the following results:

| | | kW | BHP | RPM | % CO | ppm HC |
|---|---|---|---|---|---|---|
| Road Range ie the power band normally used in highway operation | (a) Standard Fuel Injection Engine | 80.5 | 108 | 4500 | 3.5 | 125 |
| | (b) Modified to incorporate present invention | 80.5 | 108 | 4300 | 0.2 | 135 |
| Maximum Power | (a) Standard Fuel Injection Engine | 92 | 123.3 | 5500 | 3.4 | 120 |
| | (b) Modified to incorporate present invention | 103 | 138 | 5500 | 1.5 | 132 |

This table shows that large reductions in CO emissions can be achieved with little effect on HC emissions. Also, how power can be increased significantly.

An engine 1 according to the invention may be used in conjunction with an uncontrolled catalytic converter or with a Lambda-monitored closed-loop system.

Stoichiometric operation may be reserved for conditions where high catalytic conversion is required.

Figure 7:
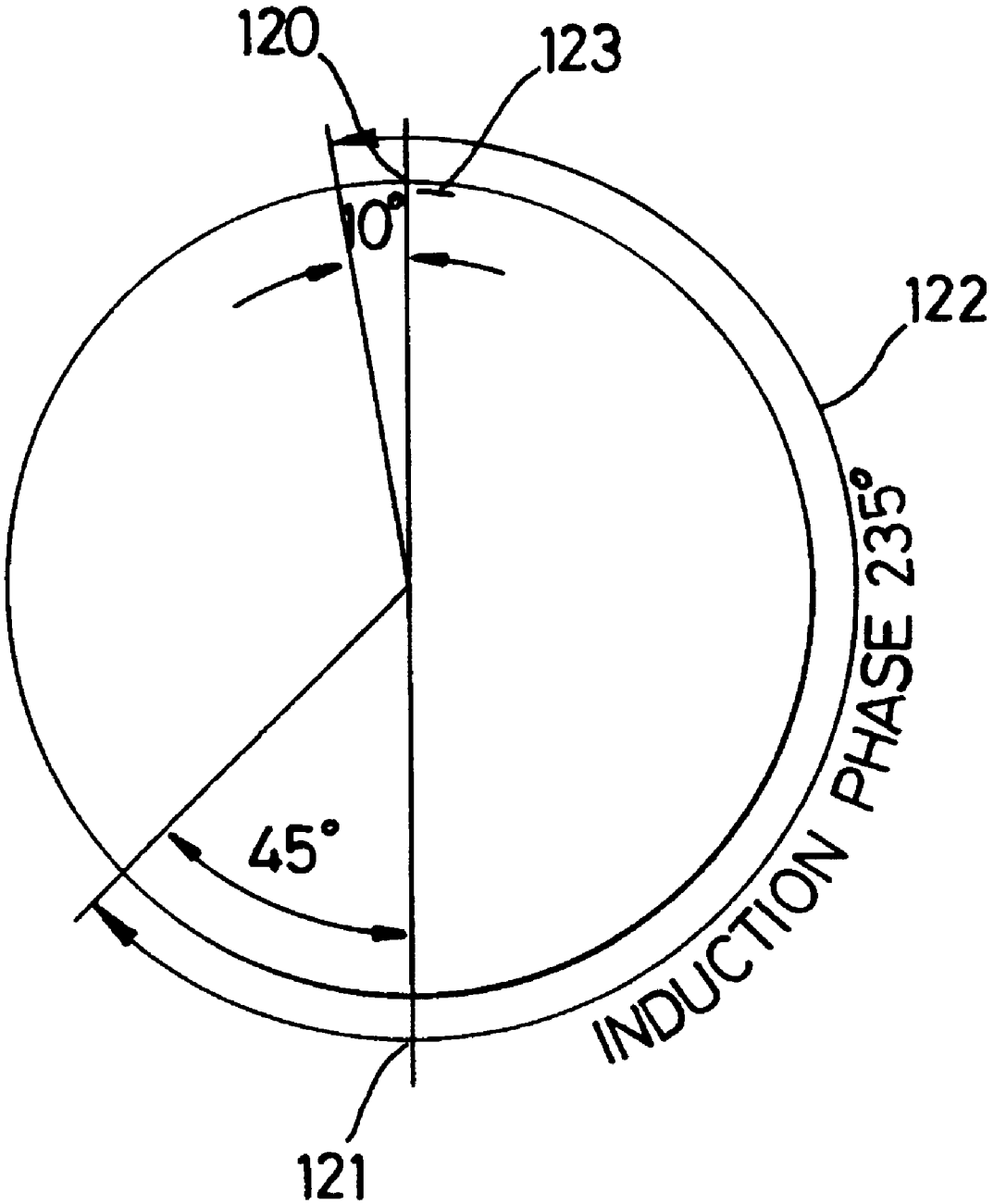
FIG. 7 is a timing diagram.

FIG. 7 is a timing diagram of the engine 1, which diagram is substantially conventional. Top Dead Centre (TDC) is shown at 120, and Bottom Dead Centre (BDC) at 121. There is a 235° induction phase 122. Inlet valve opening is at 10° before TDC and closing is at 45° after BDC. Fuel is injected at 123. The period of fuel injection varies according to operational requirements. As detailed above, in the case of the present invention, injected fuel temporarily deposited on the structure 6 (or its equivalent 40, 110), is drawn into the engine by the induction phase.

I claim:

1. A sprayer for a liquid hydrocarbon fuel injection, spark ignition, piston type internal combustion engine (1) comprising a hollow casing (3), and means (4) for injecting liquid fuel into the hollow interior of the casing, with structure (6) placed within the hollow interior (5) of the casing (3) and disposed in the path of fuel (7) injected, characterised in that the structure (6) is formed whereby injected fuel is deposited on said structure (6), so that the induction phase of the engine causes the deposited fuel to be removed from said structure (6) and into the engine (1), and in that casing outlet means (8) are provided, comprising a venturi shaped passageway, the inlet end of which is disposed downstream of and spaced from said structure (6), and operable to mix air and liquid fuel together before the mixture (24) leaves the sprayer (2).

2. A sprayer as claimed in claim 1, wherein the air/fuel mixture (24) leaves the venturi shaped passageway in micro-mist form.

3. A sprayer as claimed in claim 1, wherein the space between the structure (6) and the inlet end of the venturi shaped passageway defines a chamber (25).

4. A sprayer as claimed in claim 1, wherein the means for injecting liquid fuel into the hollow interior of the casing comprise an injection valve (4) operable to supply metered quantities of liquid fuel.

5. A sprayer as claimed in claim 4, wherein the injection valve (4) comprises a solenoid-operated injection valve.

6. A sprayer as claimed in claim 4, wherein the casing (3) and the injection valve (4) together define a chamber (20) through which combustion air is caused to flow and mix with liquid fuel discharged by the injector valve (4).

7. A sprayer as claimed in claim 1, wherein said structure (6) comprises an inner body (10) of conical form disposed within an outer body (11) of annular form so as to define an annular passageway (12) therewith.

8. A sprayer as claimed in claim 7, wherein the outer body (11) has upper (16) and inner (17) surfaces of concave form.

9. A sprayer as claimed in claim 8, wherein the upper surface (16) of the outer body (11) is disposed at an included angle of 110°.

10. A sprayer as claimed in claim 8, wherein the inner surface (17) of the outer body (11) is disposed at an angle of 30°.

11. A sprayer as claimed in claim 7, wherein the sides of the inner body (10) converge at angles of substantially 30° to the central axis (13) of the inner body.

12. A sprayer as claimed in claim 7, wherein the annular passageway (12) has a cross-sectional area of 3.1 sq mm.

13. A sprayer as claimed in claims 1, wherein at least part of the structure (6) is of sintered form (110).

14. A sprayer as claimed in claim 1, wherein the structure (6) comprises a sheet (41) of gauze.

15. A sprayer as claimed in claim 14, wherein the gauze (41) is of expanded form.

16. A sprayer as claimed in claim 14, having a body (42) disposed on the gauze sheet (41), so as to deflect sprayed fuel thereover.

17. A sprayer as claimed in claim 16, wherein the body (42) is of conical form.

18. A fuel injection spark ignition piston type internal combustion engine (2) having a sprayer as claimed in claim 1.

19. An engine as claimed in claim 18, provided with a venturi-shaped combustion air inlet tract **(34*a*) having a convergent inlet (50) and a divergent outlet (51)**.

20. An engine as claimed in claim 19, wherein the sprayer (2) is disposed at the junction of the convergent and divergent regions of the tract **(34*a*)**.

21. A sprayer for a fuel injection, spark ignition, piston type internal combustion engine, comprising:

a hollow casing;

means for injecting fuel into the interior of the casing, with structure placed within the interior of the casing and disposed in the path of the fuel that is injected, characterized in that the structure is formed whereby the injected fuel is deposited on the structure so that the induction phase of the engine causes the deposited fuel to be removed from the structure and into the engine; and a passageway for receiving fuel from the casing having a inlet end, a middle portion, and an outlet end, wherein the middle portion includes a tapering constriction, the inlet end of the passageway disposed downstream of and spaced from said structure and operable to mix air and liquid fuel together before the mixture leaves the sprayer.

22. The sprayer of claim 21, wherein the space between the structure and the inlet end of the passageway defines a chamber.

23. The sprayer of claim 21, wherein the air/fuel mixture exits the outlet end of the passageway in micro-mist form.

* * * * *